United States Patent [19]

Mittelhäuser

[11] 4,319,798

[45] Mar. 16, 1982

[54] PLUG-IN CONNECTOR FOR USE WITH ELECTRICAL SOCKETS IN MOTOR VEHICLES

[76] Inventor: Bernhard Mittelhäuser, No. 57, D-3002 Wedemark 2, Fed. Rep. of Germany

[21] Appl. No.: 121,641

[22] Filed: Feb. 14, 1980

[30] Foreign Application Priority Data

Feb. 15, 1979 [DE] Fed. Rep. of Germany ... 7904164[U]

[51] Int. Cl.[3] ..... H01R 17/00

[52] U.S. Cl. ..... 339/154 R

[58] Field of Search ..... 339/154, 153

[56] References Cited

U.S. PATENT DOCUMENTS 818,253 4/1906 Jones ..... 339/154 L

*Primary Examiner*—Joseph H. McGlynn

*Attorney, Agent, or Firm*—Becker & Becker, Inc.

[57] ABSTRACT

Tandem plug-in connectors for use with electrical sockets in motor vehicles include two plug-in connector sections each provided with, in addition to their center contacts, an external contact which is to be shifted radially of the connector body. The external contact of the front section is arranged radially beyond the external contact of the rear section in such a manner that an electrical connection is established between the external contacts, at least when the front section is inserted into a corresponding socket, i.e. in the operative position of such plug-in connector section.

1 Claim, 1 Drawing Figure

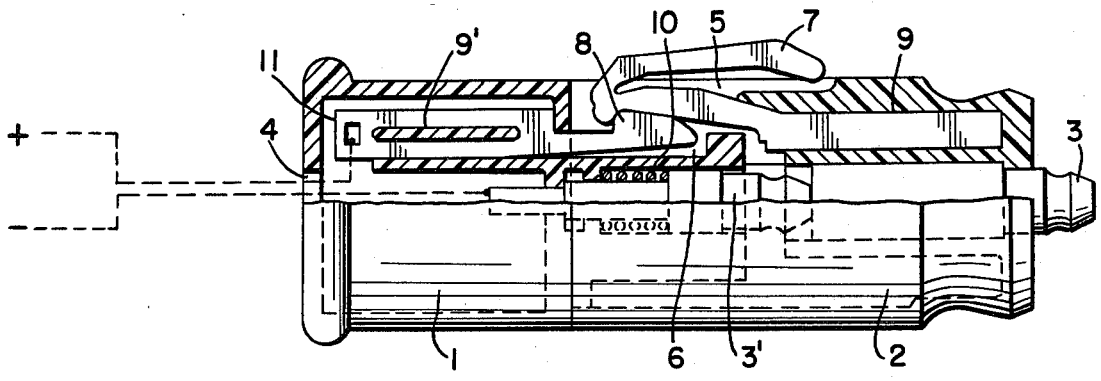
+
-
11
9'
8
10
5
7
9
4
3
1
6
3'
2

PLUG-IN CONNECTOR FOR USE WITH ELECTRICAL SOCKETS IN MOTOR VEHICLES

The present invention relates to tandem type plug-in connectors for use with electrical sockets in motor vehicles.

Plug-in connectors of this type are made with a front or fore section adapted to be inserted into certain sockets and mounted upon a rear section which, due to the particular shape of its front end, may be inserted into sockets of a different design. Thus, tandem type plug-in connectors may be used alternatively with two different kinds of sockets.

An object of the present invention is to improve plug-in connectors substantially so as to guarantee a good electrical connection between the two sections of the plug-in connectors. A further object of the invention is to attain a firm mechanical joining of the two connector sections.

These and other objects and advantages of the present invention will appear more clearly from the following specification in connection with the accompanying drawing, which shows an axial cross-section through a tandem type plug-in connector for electrical sockets in motor vehicles.

The invention is characterized primarily in that the two plug-in connector sections are each provided with, in addition to their center contacts, an external contact which is adapted to be shifted radially of the connector body. The external contact of the front section is arranged radially beyond the external contact of the rear section in such a manner that an electrical connection is established between said external contacts, at least when the front section is inserted into a corresponding socket, i.e. in the operative position of such plug-in connector section.

The particular arrangement of the external contacts ensures their perfect metallic interconnection. As a further consequence, it enables the two external contacts to be shaped so that they positively engage each other irrespective of whether the plug-in connector is not yet in its operative position i.e. in its repose position, or is in use, respectively. An advantageous effect attained thereby is that the two sections hold together and neither of them can be lost when not in use.

Referring now to the drawing in detail, the connector comprises two sections 1, 2 which are arranged sequentially in and are joined together. Each of these sections is provided with its own center contact 3, 3'. The center contact 3' of the rear section 1 is subjected to the stress or force of a compression spring 10 which forces the center contact 3' resiliently into an abutting connection against center contact 3 of the front section 2. It will be clear to those skilled in the art that center contact 3' of the rear section 1 may be provided with a wire terminal (shown in the drawing by dash lines leading towards the rear of the connector through an opening 4.

Each of the sections 1,2 is made with a radial slot 6,5 respectively. Each of these slots 5,6 has a flat lamelliform, resiliently flexible external contact 7,8 adapted to be shifted radially inwardly. The end arms of the external contacts 7,8 are tightly secured in the bodies of the corresponding sections 1,2 such as at 9, 9'. Viewed in a radial direction, the two external contacts 7,8 are arranged one after the other, so that the external contact 7 is located above the external contact 8 of the rear section 1. A hook-shaped nose of the external contact 8 is adapted to snap into a recess provided at the lower or inner edge of external contact 7 thereby holding the two sections 1,2 together when the tandem connector is not in use. However, these two sections 1,2 may be separated despite the spring tension of the external contacts 7, 8 by deflectively moving the external contact 7 in an upward direction, and the external contact 8 in a downward direction. Separation of the two sections 1,2 will be required in the event that the corresponding socket is open to access only for the front end of the rear section 1, including the center contact 3' and the external contact 8. Other types of sockets, however, permit both sections 1,2 to remain together, with the electrical connection being established via the external contact 7 and the front end center contact 3.

The center contact 3' of the rear section 1 is permanently subjected to the effect of the compression spring 10, which ensures the electrical connection to the front end center contact 3.

The external contacts are electrically connected by means of a terminal plate 11, with its corresponding cable being led through the opening 4.

The present invention is, of course, in no way limited to the specific disclosure of the specification and drawing, but also encompasses any modifications within the scope of the appended claims.

What I claim is:

1. A tandem-type plug-in connector, for use with electrical sockets in motor vehicles, which comprises:

a first section and a second section each independently usable as plugs as well as both usable when unified, said first and second sections of the tandem-type plug-in connector being capable of being connected; and an external contact respectively provided for each of said sections, one end of each of said external contacts being embedded in its pertaining section, the other end of each of said contacts being a free end adapted to be shifted radially with respect to its pertaining section, said external contacts being capable of engaging one another to effect connection of said first and second sections and electrical connection between said external contacts, with said external contact of said first section being arranged radially outwardly of said external contact of said second section in the position of connection of said first and second sections, said free end of said external contact of said second section being curved to form a hook shape that is capable of positively engaging said external contact of said first section, said external contact of said second section being shifted inwardly in a radial direction upon application of radially exerted pressure on said external contact of said first section, said first and second sections each having a center contact, one end of one of said center contacts being adapted to resiliently abut against one end of the other of said center contacts when assembled.

* * * * *